US007351112B2

(12) United States Patent
Yoap et al.

(10) Patent No.: US 7,351,112 B2
(45) Date of Patent: Apr. 1, 2008

(54) ELECTRICAL CONNECTOR DEFINING A CONTACT CURVATURE

(75) Inventors: Timothy ChinSoon Yoap, Singapore (SG); HwaLiang Ng, Singapore (SG); George P. Thomas, Singapore (SG)

(73) Assignee: Seagate Technology LLC, Scotts Valley, CA (US)

( * ) Notice: Subject to any disclaimer, the term of this patent is extended or adjusted under 35 U.S.C. 154(b) by 0 days.

(21) Appl. No.: 11/340,362

(22) Filed: Jan. 25, 2006

(65) Prior Publication Data

US 2007/0173128 A1 Jul. 26, 2007

(51) Int. Cl.
*H01R 24/00* (2006.01)

(52) U.S. Cl. ..... 439/660

(58) Field of Classification Search ..... 439/660, 439/620, 247–248

See application file for complete search history.

(56) References Cited

U.S. PATENT DOCUMENTS 3,432,795 A * 3/1969 Jayne ..... 439/60
3,831,133 A * 8/1974 Grundfest ..... 439/680
5,317,480 A 5/1994 Chandraiah et al.
5,803,771 A 9/1998 Knapp
6,322,372 B1 * 11/2001 Sato ..... 439/65
6,452,114 B1 * 9/2002 Schweitzer et al. ..... 174/261
6,453,532 B1 9/2002 Maiers et al.
6,565,387 B2 * 5/2003 Cohen ..... 439/608
2001/0044235 A1 11/2001 Cohen
2002/0055292 A1 5/2002 Maiers et al.
2003/0148666 A1 8/2003 Cohen et al.
2004/0214459 A1 10/2004 Marceau et al.
2004/0253873 A1 * 12/2004 Spykerman et al. ..... 439/620

* cited by examiner

*Primary Examiner*—Tulsidas C. Patel
*Assistant Examiner*—Phuongchi Nguyen
(74) *Attorney, Agent, or Firm*—Fellers, Snider, et al.

(57) ABSTRACT

An electrical connector apparatus comprising a housing supporting a plurality of contacts in a row, each of the contacts having an initial engagement surface, the plurality of initial engagement surfaces defining a contact curvature across the row that is configured for tangentially engaging a mating connector. A method providing an electrical device that is connectable to a receptacle by a connector having a plurality of contacts defining a contact curvature; inserting the electrical device into the receptacle to tangentially engage a portion of the connector on one of either the electrical device or the receptacle with the contact curvature on the other of the electrical device or receptacle, thereby initially contactingly engaging more than one but less than all of the plurality of contacts before contactingly engaging all the plurality of contacts.

13 Claims, 8 Drawing Sheets

ELECTRICAL CONNECTOR DEFINING A CONTACT CURVATURE

FIELD OF THE INVENTION

The embodiments of the present invention relate generally to the field of electronics devices and more particularly but without limitation to protecting electrical connector contacts from damage when connecting and disconnecting electronics devices.

BACKGROUND

Modular electronics devices are the fundamental building blocks of system customization in suiting one's particular needs. Personal computer systems, for example, are typically outfitted with a receptacle into which the user can slidingly engage a peripheral device, such as a magnetic or optical storage device. The storage device typically has one of either a male or female connector and the receptacle has the other, such that the sliding engagement electrically connects the mating connectors.

Electronics devices have generally evolved to contain more complex circuitry packed into relatively smaller enclosures. For example, a 2.5" form factor data storage device configured for the Advanced Technology Attachment (ATA) interface uses an electrical connector with 50 contacts. Packing that many contacts into such a small space means that by their size the contacts are susceptible to bending under normal insertion forces. Any such bending usually occurs during the initial contacting engagement of the male connector pins into misaligned female connector sockets.

Consequently, a significant amount of attention has been paid to ensuring adequate alignment of the connectors. Industry standards are provided for the variety of available interfaces, for example, that specify the size and location of the pins and sockets to ensure that different manufacturers' components are swappable. However, standardization hasn't solved the problem of damaged pins and sockets from misalignment, so attempts have been made at minimizing the possible misalignment conditions. For example, in some attempted solutions alignment members are attached to the data storage device and the receptacle that engage each other before the pins and sockets are engaged. In other attempted solutions surface features on the pins and sockets facilitate a smoother entry of the pin into a misaligned socket.

These attempts and others like them are relatively expensive to implement, and are increasingly problematic in the face of size and space related constraints. They also do not address the problem of misaligned connectors making initial contacting engagement at only one of the pin and socket pairs, such that the entire engagement force is initially transmitted to only one pin. What is needed is a solution whereby the pins and sockets are deliberately arranged and configured to initially contactingly engage a selected plurality of them, thereby distributing the engagement force across the plurality of pins. It is to these improvements that the embodiments of the present invention are directed.

SUMMARY OF THE INVENTION

Embodiments of the present invention are generally directed to connectors for electrical devices.

In some embodiments an electrical connector apparatus is provided comprising a housing supporting a plurality of contacts in a row, each of the contacts having an initial engagement surface, the plurality of initial engagement surfaces defining a contact curvature across the row that is configured for tangentially engaging a mating connector.

In some embodiments a method is provided comprising providing an electrical device that is connectable to a receptacle by a connector having a plurality of contacts defining a contact curvature; inserting the electrical device into the receptacle to tangentially engage a portion of the connector on one of either the electrical device or the receptacle with the contact curvature on the other of the electrical device or receptacle, thereby initially contactingly engaging more than one but less than all of the plurality of contacts before contactingly engaging all the plurality of contacts.

In some embodiments an electrical device in combination with a receptacle is provided for connecting the electrical device in electrical communication with another device. The combination has an electrical connector having one set of contacts attached to the electrical device and a respective set of contacts attached to the receptacle; and means for aligning the sets of contacts when matingly engaging the electrical device and the receptacle.

These and various other features and advantages which characterize the claimed invention will become apparent upon reading the following detailed description and upon reviewing the associated drawings.

DETAILED DESCRIPTION

Figure 1:
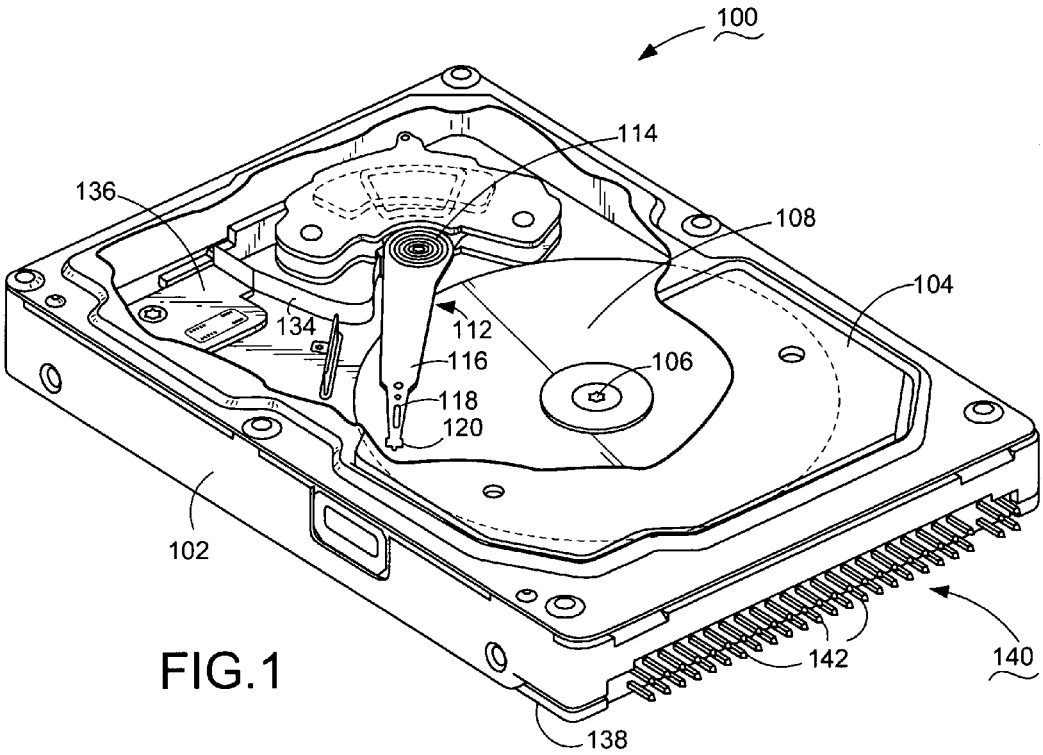
FIG. 1 is an isometric view of a data storage device constructed in accordance with embodiments of the present invention.

Referring to the drawings in general, and more particularly to FIG. 1 that shows an isometric view of a data storage device 100 constructed in accordance with embodiments of the present invention. The device 100 preferably includes a base 102 and a cover 104 (partially cutaway), which together provide a housing for a number of components. The components include a motor 106 to which one or more data storage mediums 108 are mounted for rotation therewith. Adjacent the medium 108 is an actuator assembly 112 that pivots around a bearing assembly 114. The actuator assembly 112 includes an actuator arm 116 supporting a load arm 118 that, in turn, supports a head 120 in a data transfer relationship with the adjacent medium 108. Each medium 108 can be divided into data tracks, and the head 120 is positioned to retrieve data from and store data to the tracks.

To provide the requisite electrical conduction paths between the head 120 and device 100 control circuitry, head wires can be routed on the actuator assembly 112 from the head 120, along the load arm assembly 118 and the actuator arm 116, and to a flex circuit 134. The head wires are thus connected to one end of the flex circuit 134 and the other end is connected to a flex circuit bracket 136. There the electrical connections pass through the base 102 to a printed circuit board (PCB) 138, which can be mounted externally to the enclosure.

An electrical connector 140 attached to the PCB 138 has a plurality of contacts for connecting the device 100 to a mating connector (not shown), such as for placing the device 100 in communication with external control circuitry. The embodiments of FIG. 1 illustrate the use of a male electrical connector 140, having pins 142 that are matingly alignable with and insertable into a like number and arrangement of sockets in a mating female connector (not shown). In alternative equivalent embodiments, however, the device 100 can have a female connector that is alignable with and receivingly engageable of a male connector.

Figure 2:
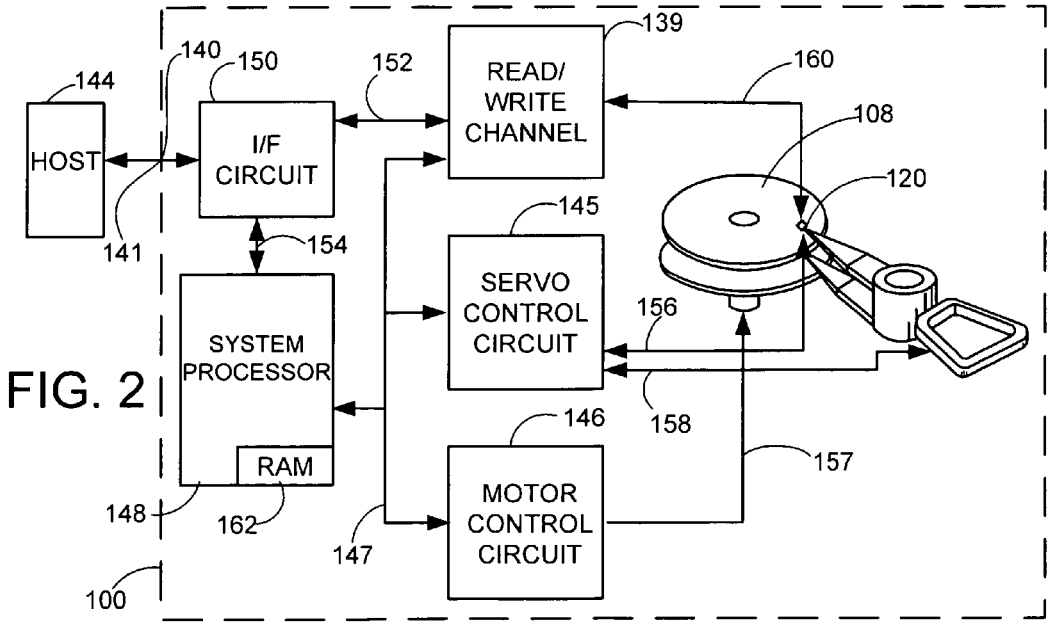
FIG. 2 is a functional block diagram of the data storage of FIG. 1 connected to a host.

FIG. 2 is a functional block diagram illustrating types of control signals and data transfers that are passed between the device 100, having the connector 140, and a host 144, having a mating connector 141. The device 100 generally has a read/write channel 139, a servo control circuit 145, and a motor control circuit 146, all connected by a control bus 147 to a controlling system processor 148. An interface circuit 150 is connected to the read/write channel 139 by bus 152 and to the system processor 148 by bus 154. The interface circuit 150 serves as a communications interface between the device 100 and the host device (or other network server) 144. Generally, in response to an access command from the host 144 and received by the system processor 148 from the interface 150, the processor 148 controls the flow of data to and from the medium 108. The read/write channel 139 in turn, provides store and retrieve signals to the head 120 in order to store data to the medium 108 and retrieve data from the medium 108. The head 120 can, for example, provide an analog read signal to the read/write channel 139, which in turn converts the analog read signal to digital form and performs the necessary decoding operations to provide data to the interface circuit 150 for output to the host 144.

Figure 3:
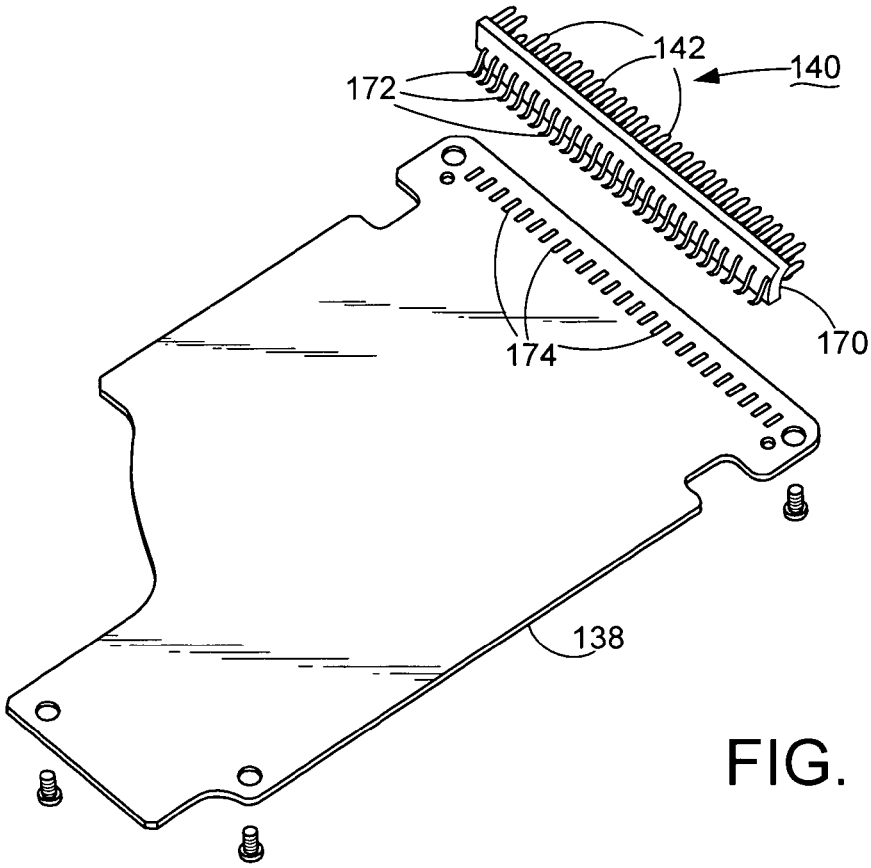
FIG. 3 is a partial exploded view of the printed circuit board and connector of the data storage device of FIG. 1.
Figure 4:
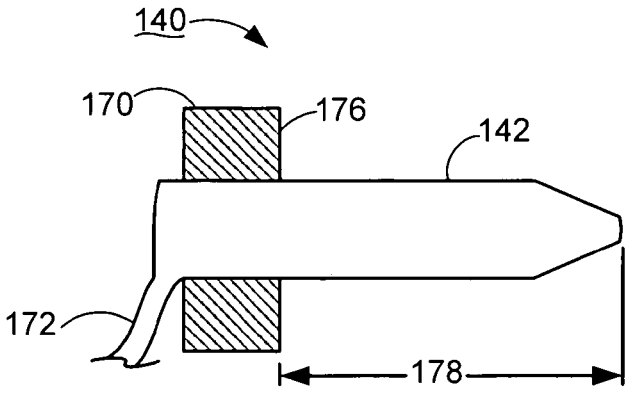
FIG. 4 is a partial cross sectional view of the connector of FIG. 3.

FIG. 3 is an exploded view of the PCB 138 and its connector 140. The connector 140 generally has a dielectric housing 170 supporting the plurality of pins 142 on one side thereof with leads 172 from each of the pins 142 connected to corresponding pads 174 of the PCB 138. FIG. 4 is a partial cross sectional view of one of the pins 142, showing the manner in which it extends laterally from a longitudinal surface 176 of the housing 170, thereby defining an effective length 178. For purposes of this description and the appended claims, the term "effective length" means the length of the pin 142 extending beyond the surface 176 of the housing 170. In some embodiments where the mating connector (not shown) abuttingly engages the surface 176 when fully engaged, then the effective length 178 is also the insertion length of the pins 142. The distal end of each pin 142 and of each socket 143 defines an initial engagement surface that first contactingly engages an opposing connector during connection therewith.

Figure 5:
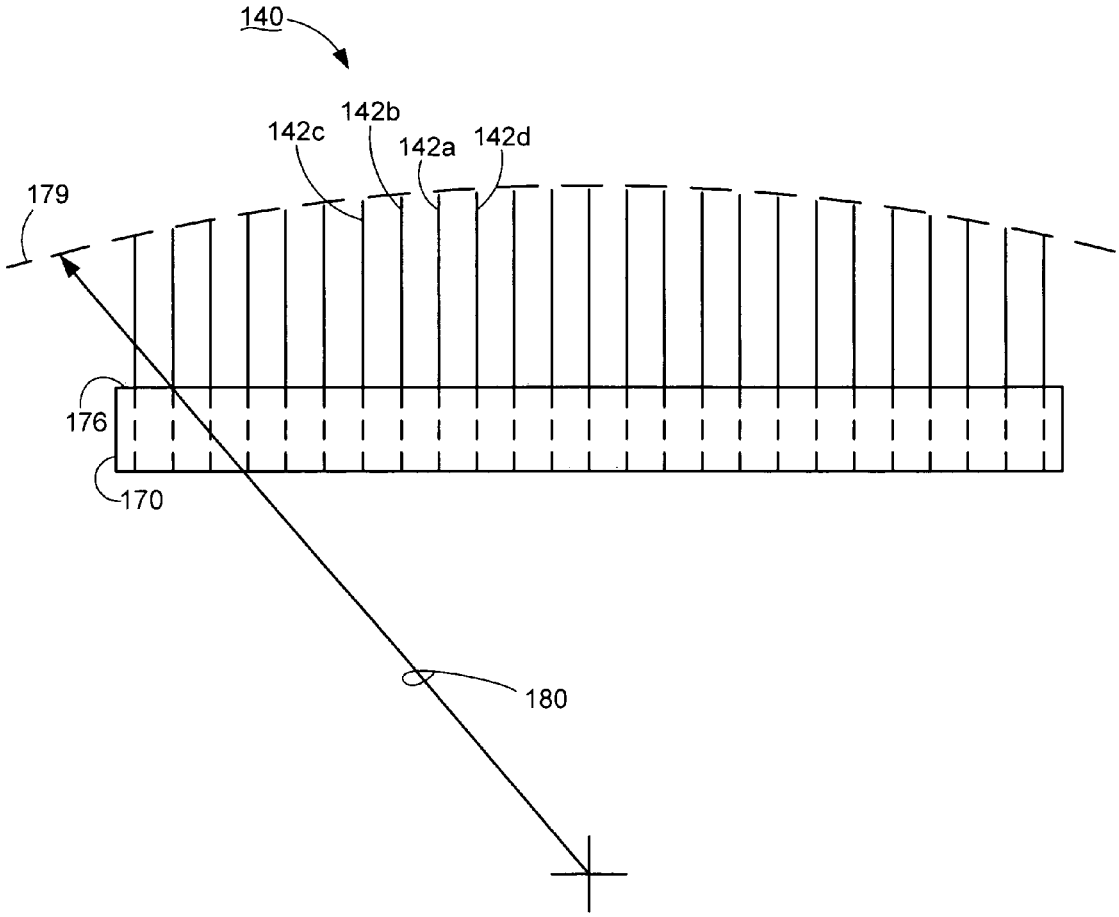
FIG. 5 is a diagrammatic plan view of the connector of FIG. 3.
Figure 6:
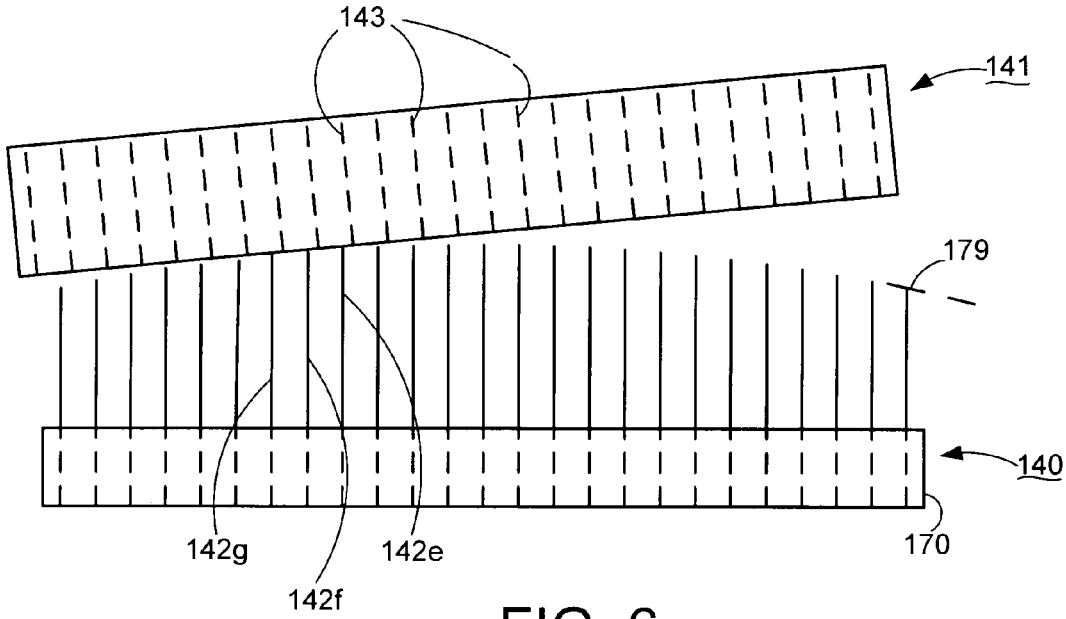
FIG. 6 is a diagrammatic plan view of a connector constructed in accordance with embodiments of the present invention to provide a tangential contacting engagement with a contact curvature.

FIG. 5 is a diagrammatic plan view of the connector 140 more clearly illustrating the manner in which the pins 142 define different effective lengths 178 across a row of the contacts. That is, outwardly disposed pins 142*a*, 142*b*, 142*c* in the row have effective lengths 178 that are incrementally shorter in relation to the effective length 178 of a centrally disposed contact 142*d*. The distal ends of the pins 142 define an arcuate contact curvature 179, preferably with a common radius of curvature (R) 180. As shown in FIG. 6, this arrangement permits the connector 141 to tangentially engage the contact curvature 179 at the initial contacting engagement of the connectors 140, 141, regardless of any misalignment therebetween. By "tangentially engage" it is meant that a selected number of the pins 142, in this case three pins 142*e*, 142*f*, 142*g* contactingly engage a respective number of sockets 143 at the initial contacting engagement of the connectors 140, 141. The tangentially engaged pins 142*e*, 142*f*, 142*g* bear the engagement force until its continued application aligns the connectors 140, 141 so that the rest of the pins 142 and sockets 143 can engage. Tangentially engaging the contact curvature 179 thus distributes the engagement force across the preselected number of pins 142. Accordingly, each pin 142 bears relatively less force than where the entire engagement force is supported by only one pin, such as in the straight connector of FIG. 7 with regard to pin 184.

Figure 7:
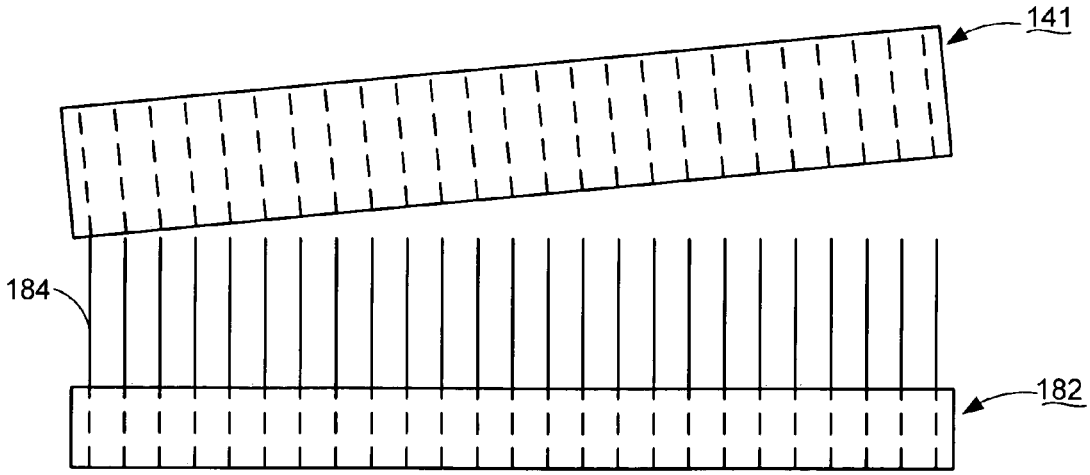
FIG. 7 Related Art
FIG. 7 is a diagrammatic plan view of a connector constructed in accordance with previous related art solutions.
Figure 8:
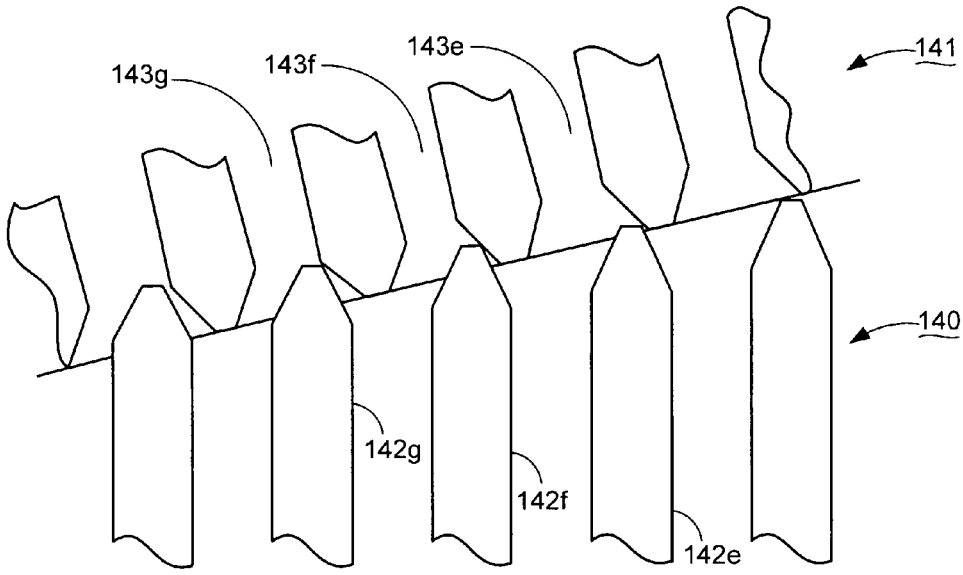
FIG. 8 is an enlarged detail view of a portion of the connector of FIG. 6.
Figure 9:
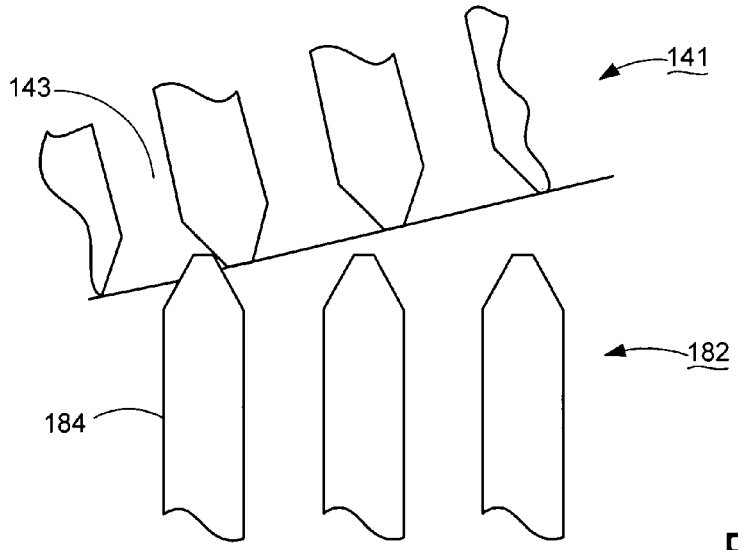
FIG. 9 is an enlarged detail view of a portion of the connector of FIG. 7.

FIGS. 8 and 9 are enlarged detail views of FIGS. 6 and 7, respectively, more clearly showing that during the initial contacting engagement the pins 142*e*, 142*f*, 142*g* in FIG. 8 each bear about ⅓ the force that pin 184 of FIG. 9 bears. The pins 142 are thereby less likely to bend as they slidingly engage the chamfered surfaces of the sockets 143, thereby bringing the connectors 140, 141 into a fine alignment whereat the other pins 142 and sockets 143 are aligned.

Figure 11:
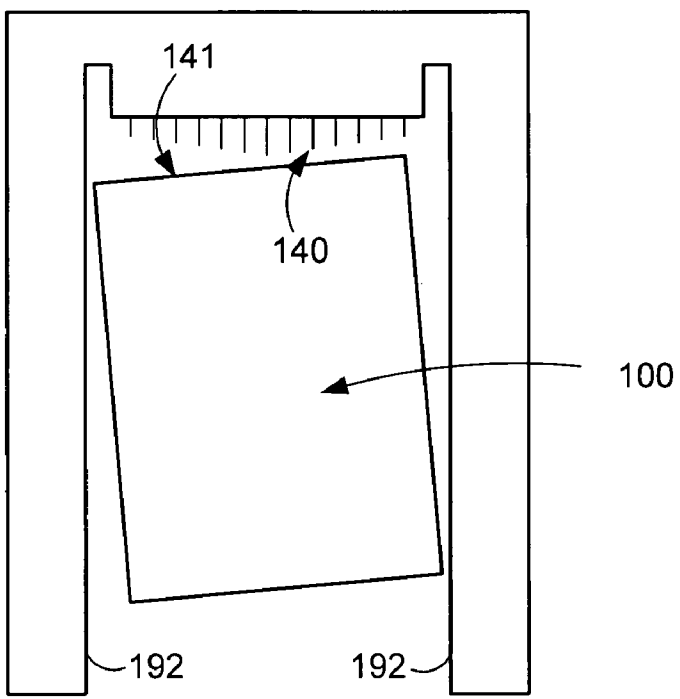
FIG. 11 is similar to FIG. 10 but showing the data storage device misaligned within the receptacle.
Figure 10:
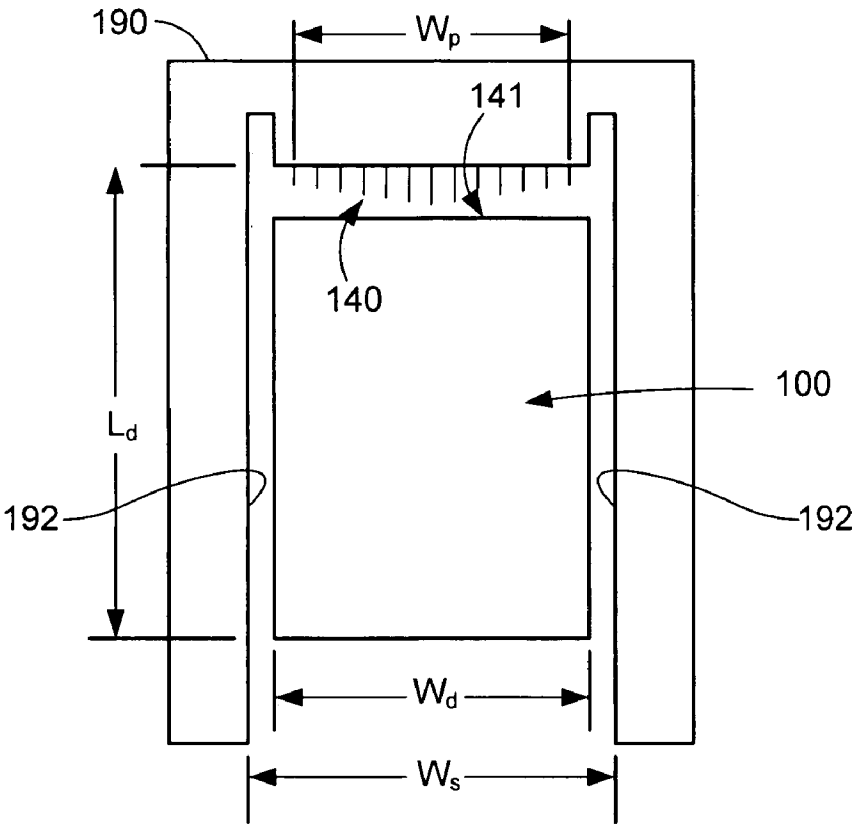
FIG. 10 is a diagrammatic plan view of the data storage device of FIG. 1 slidingly engaging a receptacle.
Figure 12:
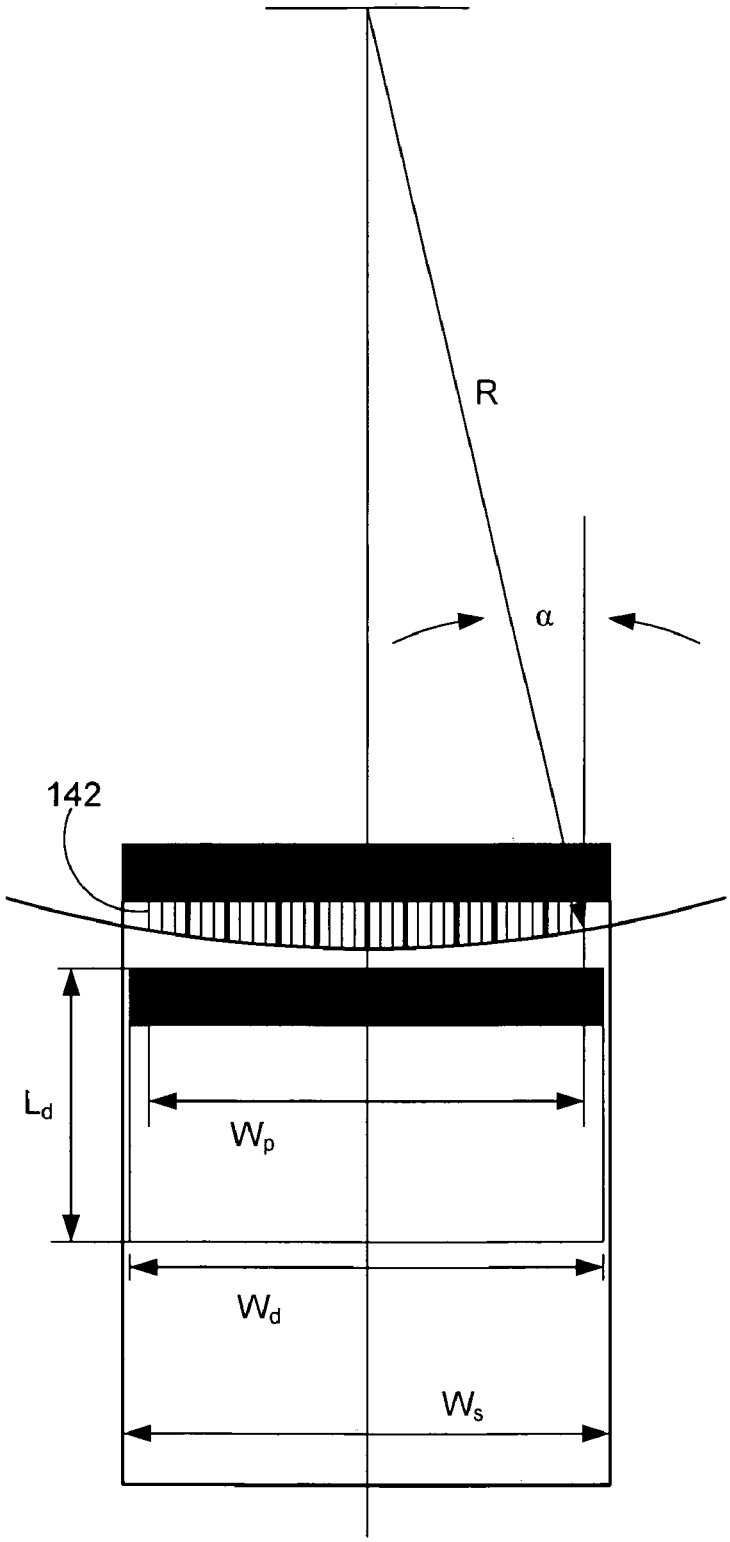
FIG. 12 is a diagrammatic view related to the derivation of the radius of contact curvature.

FIGS. 10-12 are diagrammatical plan views of the device 100 having the female connector 141 as a part thereof for connecting to a receptacle 190 having the male connector 140 as a part thereof. The receptacle 190 can be any of a number of devices used in conjunction with a data storage device, such as but not limited to a computer chassis, a multiple disc array carrier, a testing bay, and the like. Also, in equivalent alternative embodiments the female connector 141 can be part of the receptacle 190 and the male connector 140 part of the device 100, as illustrated in FIG. 1.

For facilitating the engagement of the connectors 140, 141 it can be advantageous to provide opposing guides 192 in the receptacle 190 for sliding the device 100 toward the connector 140. Clearances are necessary between the device 100 and the guides 192 in order to slide the device 100 into contacting engagement without undue force or damage. However, the extent of possible misalignment is directly proportional to the amount of clearance. The amount of clearance is related to the width of the device, $W_d$, which is less than the width of the space between the guides, $W_s$. Although the clearance is pictorially exaggerated in FIGS. 10 and 11 for clarity sake, FIG. 11 illustrates how the device 100 can become misaligned within the guides 192 during the sliding engagement.

The radius of the contact curvature (R) 180 for the pins 142 of the male connector can be calculated in relation to $W_d$ and $W_s$, the length of the device, $L_d$, and the width of the row of pins 142, $W_r$. In some embodiments a tilt angle, α, of the connector 141 can be calculated in terms of these dimensions as follows:

$$\alpha = \tan^{-1}\left[\frac{L_d}{W_d}\right] - \cos^{-1}\left[\frac{W_s}{\sqrt{L_d^2 + W_d^2}}\right]$$

R can then be calculated in terms of α and $W_r$ as follows:

$$R = \frac{W_r}{2\cos(\alpha)\sin(\alpha)}$$

Curve fitting can then be used to calculate the number of pins 142 that contactingly engage the sockets 143 at the tangential contacting engagement. For the tangentially engaged pins 142, the included angle of the socket 143 within the chamfered portion, β, and the insertion depth in the socket 143 within the chamfered portion, δ, are related in terms of:

$$\delta = R(1 - \cos(\beta))$$

Solving this relationship for β provides:

$$\beta = \cos^{-1}\left[1 - \frac{\delta}{R}\right]$$

Given a pitch of the pins 142, ρ, the minimum number of pins 142 in tangential contacting engagement is calculated as:

$$NUM = R\left[\frac{\sin(\beta)}{2\rho}\right]$$

The radius of curvature R can thus be adjusted to provide a preselected number of tangentially engaging pins 142, based on, for example, a desired maximum stress on each pin 142 resulting from the engagement force.

Figure 13:
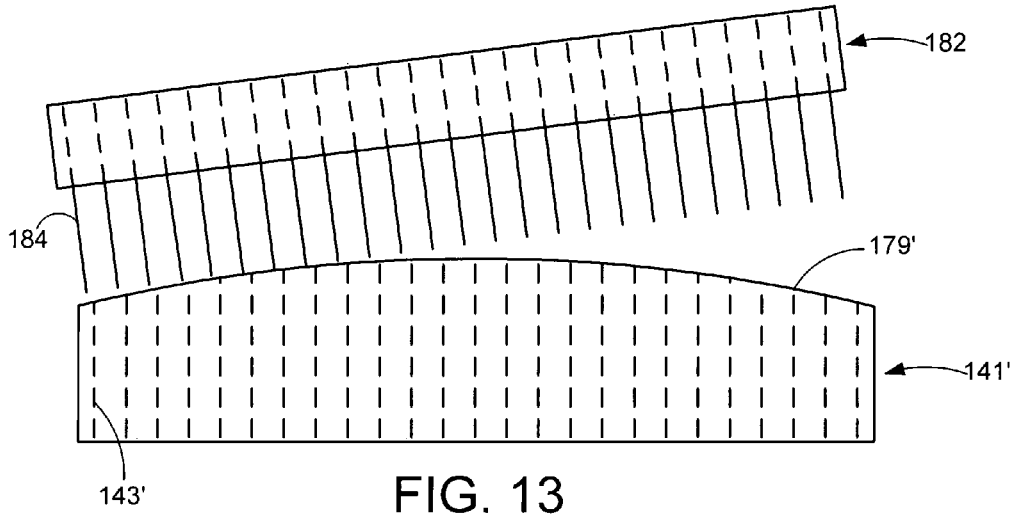
FIG. 13 is a diagrammatic plan view of a connector constructed in accordance with alternative embodiments of the present invention.
Figure 14:
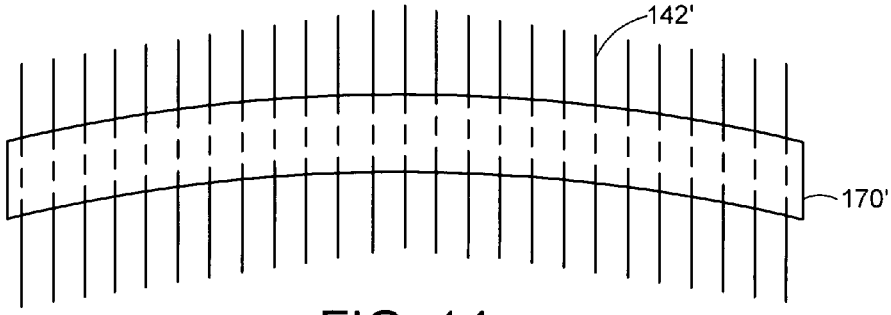
FIG. 14 is a diagrammatic plan view of a connector constructed in accordance with alternative embodiments of the present invention.

The contemplated embodiments are not limited to the description of the illustrative embodiments discussed hereinabove. For example, the embodiments of FIG. 6 and others illustrate the male connector 140 having different length pins 142 defining the contact curvature 179. The skilled artisan readily recognizes that in alternative equivalent embodiments of FIG. 13 the female connector 141' has a curvilinear face defining the contact curvature 179' for tangentially engaging the straight pins 184 of the male connector 182. For another example, the embodiments of FIG. 6 and others illustrate the male connector 140 having a linear housing 170 from which different-length pins 142 extend defining the contact curvature 179. The skilled artisan readily recognizes that in alternative equivalent embodiments the pins 142 can be of equal length with the insertion depth incrementally varied in order to define the contact curvature 179. Alternatively, FIG. 14 illustrates the housing 170' being curvilinear with equal-length pins 142' at a common insertion depth to define the contact curvature 179. Using a common length of pins 142 simplifies the production process by significantly reducing the number of unique parts making up a connector assembly.

In some embodiments one or more ground contacts are included within the plurality of contacts for hot-swappable applications. In some embodiments a ground contact can be a contact pin that extends longer than any of the other pins so that it electrically engages a mating connector before any other contact electrically engages, regardless of any misalignment between the connectors. In equivalent alternative embodiments a plurality of ground contact pins can extend longer than the other contact pins, with the ground pins themselves defining their own radius of contact curvature so that a preselected number of them initially contactingly engage in the same ways and for the same reasons discussed above. In other equivalent alternative embodiments the ground contacts can form part of the contact curvature and be interspersed throughout the row so that at least one of the ground contacts is always within the preselected number of tangentially engaged contacts, regardless of any misalignment between the connectors.

It is to be understood that even though numerous characteristics and advantages of various embodiments of the present invention have been set forth in the foregoing description, together with details of the structure and function of various embodiments of the invention, this detailed description is illustrative only, and changes may be made in detail, especially in matters of structure and arrangements of parts within the principles of the present invention to the full extent indicated by the broad general meaning of the terms in which the appended claims are expressed. For example, the particular elements may vary depending on the devices in which they are incorporated or the particular environment in which they are used without departing from the spirit and scope of the present invention.

In addition, although the illustrative embodiments described herein are directed to a data storage system, it will be appreciated by those skilled in the art that the claimed subject matter is not so limited and various other electronic devices can utilize the embodiments of the present invention without departing from the spirit and scope of the claimed invention.

What is claimed is:

1. An electrical connector apparatus comprising a housing supporting a plurality of contacts in a row with insertion lengths that vary incrementally, distal ends of the plurality of contacts defining a continuous arcuate contact curvature disposed along a constant radius of curvature across the entire row, the disposition of the plurality of contacts thereby configured for making an initial contacting engagement, with respect to the entire plurality of contacts, simultaneously by two or more adjacent different length contacts of the plurality of contacts but less than the entire plurality of contacts when connecting the electrical connector and a mating connector together.

2. The apparatus of claim 1 characterized as a female connector wherein the initial contacting engagement surfaces are substantially flush with an arcuate longitudinal surface of the housing.

3. The apparatus of claim 1 connected to an electrical device that is slidable in a guide for engagement with a mating connector, wherein a radius of the contact curvature (R) is determined in relation to a length of the electrical device ($L_d$), a width of the electrical device ($W_d$), a width of a space defined by the guide ($W_s$), and a width of the row of contacts ($W_r$).

4. The apparatus of claim 3 wherein the radius of curvature is defined by:

$$R = \frac{W_r}{2\cos(\alpha)\sin(\alpha)}$$

where $$\alpha = \tan^{-1}\left[\frac{L_d}{W_d}\right] - \cos^{-1}\left[\frac{W_r}{\sqrt{L_d^2 + W_d^2}}\right].$$

5. The apparatus of claim 1 characterized as a male connector wherein the contacts extend laterally from a longitudinal surface of the housing defining the different insertion lengths, and wherein outwardly disposed contacts in the row define insertion lengths that are incrementally shorter in relation to a centrally disposed contact in the row.

6. The apparatus of claim 5 wherein the longitudinal surface of the housing is linear and the contacts comprise different overall lengths.

7. The apparatus of claim 5 wherein the longitudinal surface of the housing is linear and the contacts comprise a common overall length.

8. The apparatus of claim 5 wherein the longitudinal surface of the housing is curvilinear.

9. A method comprising:

providing an electrical device that is connectable to a receptacle by a connector having a plurality of contacts of incrementally different insertion lengths, distal ends of the plurality of contacts thereby defining a continuous arcuate contact curvature of a constant radius of curvature;

inserting the electrical device into the receptacle to make an initial contacting engagement with only a subset of the plurality of contacts, whereby an initial insertion force producing the initial contacting engagement is distributed simultaneously among two or more adjacent different length contacts making the initial contacting engagement but less than the entire plurality of contacts.

10. The method of claim 9 wherein the providing step is characterized by defining the contact curvature in a female connector.

11. The method of claim 9 wherein the providing step is characterized by orienting a portion of the connector defining the contact curvature in convex relation to a mating portion of the connector.

12. The method of claim 9 wherein the providing step is characterized by defining the contact curvature in a male connector.

13. The method of claim 12 wherein the providing step is characterized by defining the contact curvature by a plurality of contact pins having the same overall length.

* * * * *